US009901931B2

(12) United States Patent
Yen et al.

(10) Patent No.: US 9,901,931 B2
(45) Date of Patent: Feb. 27, 2018

(54) MAGNETIC FILTER

(71) Applicants: Kosky Yen, Taipei (TW); Peter Wu, Taipei (TW); Michael Lee, Taipei (TW); Charles Chen, Taipei (TW)

(72) Inventors: Kosky Yen, Taipei (TW); Peter Wu, Taipei (TW); Michael Lee, Taipei (TW); Charles Chen, Taipei (TW)

(73) Assignee: ALLNEW Chemical Technology Company, Taipei (TW)

( * ) Notice: Subject to any disclaimer, the term of this patent is extended or adjusted under 35 U.S.C. 154(b) by 339 days.

(21) Appl. No.: 14/583,464

(22) Filed: Dec. 26, 2014

(65) Prior Publication Data

US 2016/0184833 A1 Jun. 30, 2016

(51) Int. Cl.

| | |
|---|---|
| ***B03C 1/032*** | (2006.01) |
| ***B03C 1/033*** | (2006.01) |
| ***B03C 1/28*** | (2006.01) |

(52) U.S. Cl.

CPC ..... *B03C 1/032* (2013.01); *B03C 1/0332* (2013.01); *B03C 1/0335* (2013.01); *B03C 1/284* (2013.01); *B03C 1/286* (2013.01); *B03C 2201/18* (2013.01)

(58) Field of Classification Search

CPC ..... B03C 1/032; B03C 1/0332; B03C 1/0335; B03C 1/28; B03C 1/284; B03C 1/286; B03C 1/30; B03C 2201/18; C02F 1/48; C02F 1/481; C02F 1/484; C02F 1/488; B01D 35/06

See application file for complete search history.

(56) References Cited

U.S. PATENT DOCUMENTS

| | | | |
|---|---|---|---|
| 3,143,496 | A | 8/1964 | Maretzo |
| 3,195,728 | A | 7/1965 | Sommermeyer |
| 3,539,509 | A | 11/1970 | Heitmann et al. |
| 3,873,448 | A | 3/1975 | Isberg et al. |
| 4,190,524 | A | 2/1980 | Watson |
| 4,462,906 | A | 7/1984 | Inaba et al. |
| 4,594,160 | A | 6/1986 | Heitmann et al. |
| 4,619,770 | A | 10/1986 | Boston |
| 4,722,788 | A | 2/1988 | Nakamura |
| 5,043,063 | A | 8/1991 | Latimer |
| 5,427,249 | A | 6/1995 | Schaaf |
| 5,470,466 | A | 11/1995 | Schaaf |

(Continued)

FOREIGN PATENT DOCUMENTS

| | | | |
|---|---|---|---|
| GB | 850233 | A | 10/1960 |

*Primary Examiner* — David C Mellon
(74) *Attorney, Agent, or Firm* — Charles H Jew

(57) ABSTRACT

A high capacity magnetic filter for separating magnetic and non-magnetic contaminants from contaminated liquid streams includes a housing having (i) an interior region between the inlet and outlet for a process stream, (ii) a plurality of vertically oriented, elongated non-magnetic holder sleeves positioned within the interior region (iii) paramagnetic metal packing material that is randomly distributed in the interior region to form a packed compartment that has a void volume which is above 95 percent, and (iv) a device to generate a magnetic field within the interior region. Generation of a uniform magnetic field within the packed compartment magnetizes the holder sleeves and matrix of packing materials. The holder sleeves and matrix create a large surface area for collecting the contaminants.

12 Claims, 5 Drawing Sheets

(56) References Cited

U.S. PATENT DOCUMENTS

| | | | | |
|---|---|---|---|---|
| 5,766,450 | A | 6/1998 | Herman et al. | |
| 5,819,949 | A | 10/1998 | Schaaf et al. | |
| 6,730,217 | B2 | 5/2004 | Schaff et al. | |
| 7,879,225 | B2 | 2/2011 | Lee et al. | |
| 8,506,820 | B2 | 8/2013 | Yen et al. | |
| 8,636,907 | B1 | 1/2014 | Lin et al. | |
| 8,900,449 | B2 | 12/2014 | Lin et al. | |
| 2004/0182769 | A1* | 9/2004 | Fogel | B01D 35/06 210/222 |
| 2009/0236287 | A1* | 9/2009 | Vero | B01J 20/28009 210/663 |
| 2013/0240455 | A1* | 9/2013 | Lin | B03C 1/286 210/695 |

* cited by examiner

MAGNETIC FILTER

FIELD OF THE INVENTION

The present invention relates to robust, high capacity magnetic filters for removing magnetic and non-magnetic contaminants from commercial process streams in refinery and chemical industries.

BACKGROUND OF THE INVENTION

Magnetic filters have been used to remove magnetic contaminants from industrial process streams. For example, U.S. Pat. No. 8,506,820 to Yen et al. and U.S. Pat. No. 8,636,907 to Lin et al. describe filters having removable permanent magnetic bars that are disposed within non-magnetic sleeves. During the filtration process, magnetic contaminants adhere onto the external surfaces of the sleeves. The contaminants disengage from the sleeves once the permanents magnetic bars are removed from the sleeves. Prior art devices also employ metal matrices that are magnetized by magnetic fields produced by an external electromagnetic coil as exemplified by U.S. Pat. No. 3,539,509 to Heitmann et al., U.S. Pat. No. 3,873,448 to Isberg et al., U.S. Pat. No. 4,594,160 to Heitmann et al, U.S. Pat. No. 4,722,788 to Nakamura, and U.S. Pat. No. 5,766,450 to Herman et al. Prior art magnetic filters with metal matrices are deficient in that the filters are low capacity with uneven contaminant capture and accumulation across the matrix.

SUMMARY OF THE INVENTION

The present invention is based in part on the recognition that the efficiency of magnetic filters, that are equipped with metal matrices in the form of metal packing materials, can be significantly enhanced by the generation of uniform magnetic fields within the interior region of the filter that encloses the metal packing materials. The magnetic filters are particularly suited for removing degradation sludge, iron containing particles or flakes, as well as non-magnetic polymeric materials from the process streams in refinery and chemical plants.

Accordingly in one aspect, the invention is directed to a magnetic filter for separating magnetic and non-magnetic contaminants from a contaminated liquid process stream that includes:

a housing having (i) a process stream inlet (ii) a process stream outlet (iii) an interior region between the inlet and outlet (iii) a plurality of vertically oriented, elongated non-magnetic holder sleeves positioned within the interior region;

paramagnetic metal packing material that is randomly distributed in the interior region to form a packed compartment that has a void volume which is above 95 percent; and means for generating a magnetic field within the packed compartment.

The magnetic filter does not require external coils of insulated wire wound around the housing. The magnetic filter affords a compact design that is capable of developing high intensity, uniform magnetic fields across the packed compartment that is occupied by the paramagnetic metal packing material. As a result, the magnetic filter with its high contact surface area created by the holder sleeves and packing material matrix, can efficiently remove both magnetic and non-magnetic contaminants from industrial process streams.

In another aspect, the invention is directed to a method of removing magnetic and non-magnetic particles from a contaminated liquid process stream that includes the steps of:

(a) providing a magnetic filter device that includes:

a housing having (i) a process stream inlet (ii) a process stream outlet (iii) an interior region between the inlet and outlet (iii) a plurality of vertically oriented, elongated non-magnetic holder sleeves positioned within the interior region;

paramagnetic metal packing material that is randomly distributed in the interior region to form a packed compartment that has a void volume is above 95 percent; and means for generating a magnetic field within the packed compartment;

(b) activating the means for generating the magnetic field;

(c) connecting the contaminated liquid process stream to the inlet of the magnetic filter, such that as the contaminated liquid process stream initially flows pass the holder sleeves, magnetic contaminants adhere to the exterior of the holder sleeves and to the exterior surfaces of the packing material and subsequently as the contaminated liquid process stream continues pass the filter screen non-magnetic contaminants of the desired size are removed by the filter screen to thereby form a treated process stream that exits through the outlet;

(d) terminating the flow of the contaminated liquid process stream into the inlet;

(e) de-activating the means for generating the magnetic field, to thereby release magnetic contaminants that have adhered to the exterior surfaces of the holder sleeves and packing material; and (f) flushing out magnetic and non-magnetic contaminants from the screen cylinder.

DESCRIPTION OF THE PREFERRED EMBODIMENTS

Figure 1A:
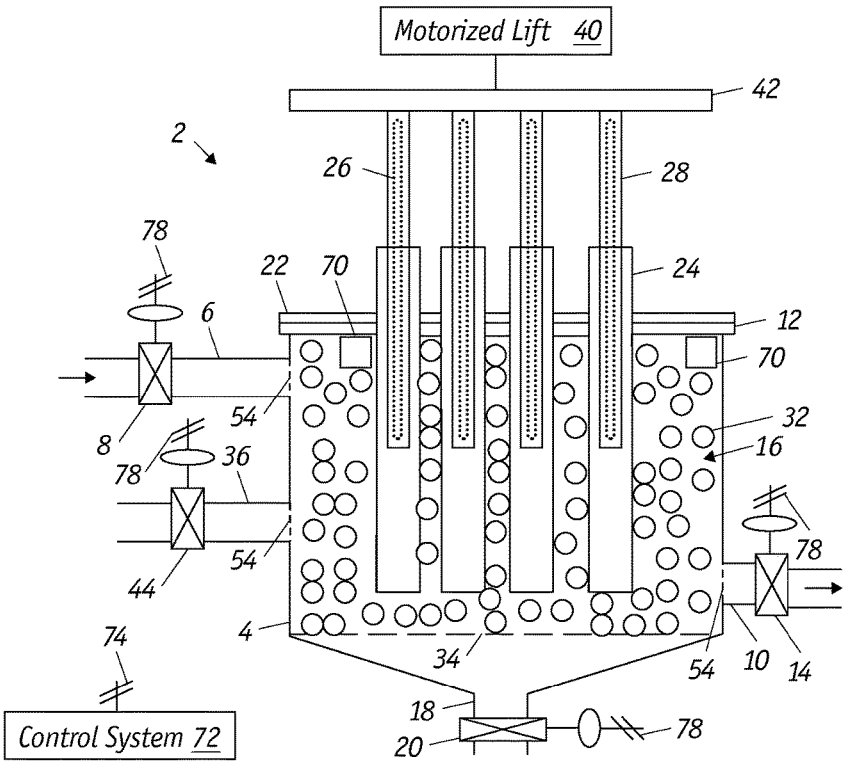
FIG. 1A and FIG. 1B are side and top views, respectively, of an embodiment of a magnetic filter with paramagnetic metal packing and removable permanent magnetic bars, with FIG. 1B depicting the magnetic filter with the cover plate removed and illustrating a larger number of sleeve holders.
Figure 1B:
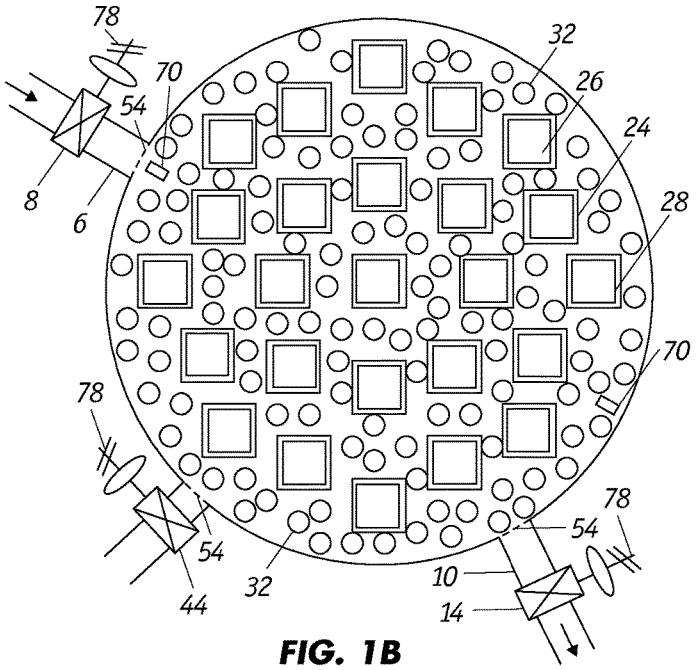

As shown in FIGS. 1A and 1B, the magnetic filter 2 comprises a housing 4 having an inlet pipe 6 that can be coupled to a contaminated process stream through control valve 8 and an outlet pipe 10 from which a treated process stream exits through control valve 14. Housing 4 defines an interior region 16. Flow through drain pipe 18, which is welded to the bottom of housing 4, is regulated with control valve 20 which is normally closed during filtration operation but which is opened during clean-up service to discharge flush fluid from housing 4. The size of the opening in drain pipe 18 is sufficient to accommodate large particles that accumulate in the filtration process so that contaminants can be readily flushed out during the clean-up cycle.

Figure 1C:
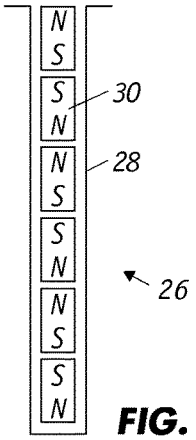
FIG. 1C is a cross sectional view of a permanent magnetic bar.

A cover plate 22, which is equipped with a plurality of vertically oriented elongated holder sleeves 24, is fastened to an annular flange 12 that is welded to the outer perimeter along the top opening in housing 4. Holder sleeves 24 are preferably welded to cover plate 22 so as to form integral units therewith. Each elongated holder sleeve 24 is constructed of a non-magnetic metal such as stainless steel and each has a chamber that accommodates one or more magnet blocks that are encased to form a permanent magnetic bar assembly 26. In particular, as shown in FIG. 1C, each permanent magnetic bar assembly 26 includes a non-magnetic enclosure 28 that encases a plurality of short magnet blocks 30 that are arranged in tandem with like poles positioned adjacent to each other.

As further illustrated in FIG. 1A, the upper portions of holder sleeves 24 have external extensions that protrude out from cover plate 22. In this fashion, the entire length of each permanent magnetic bar assembly 26 can be completely removed from interior region 16 while the lower portion of each assembly remains within their respective holder sleeves 24. The lengths of holder sleeves 24 are preferably the same as that of the assemblies 26 so that the assemblies can extend far into interior region 16. The automatic operation of magnetic filter 2 is regulated by a control system 72, which includes antenna 74 and control valve antennas 78.

Holder sleeve 24, magnet blocks 30 and enclosures 28 preferably have square cross sections but it is understood that they can circular or other configurations. With the permanent magnetic bar assemblies 26 disposed within holder sleeves 24, contaminants containing magnetic materials are attracted by the magnetic fields produced by the permanent magnetic bar assemblies 26 so that contaminants adhere onto the exterior surfaces of the elongated holder sleeves 24, which are within interior region 16. There is no leakage of process fluid into holder sleeves 24 which are completely sealed from interior 16. The permanent magnetic bar assembles 26 are secured to a lifting plate 42 which is connected to a motorized lifting apparatus 40.

Figure 1D:
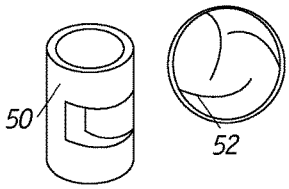
FIG. 1D illustrates a packing material.
Figure 5A:
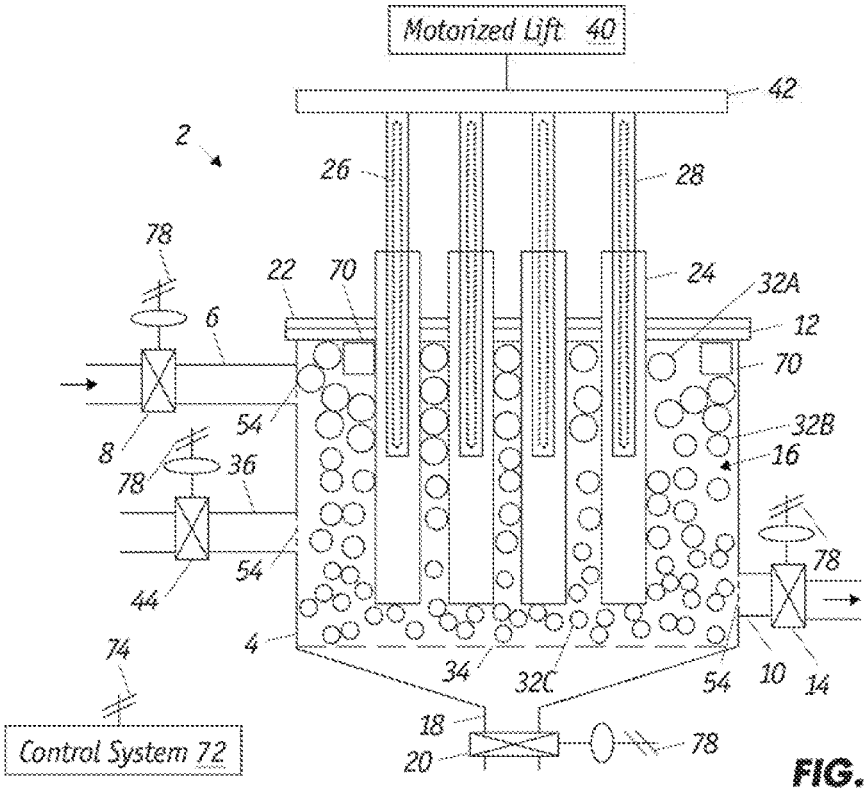
FIG. 5A is an embodiment of a magnetic filter with packing material of different sizes and FIG. 5B illustrates a perforated saddle packing material.
Figure 5B:
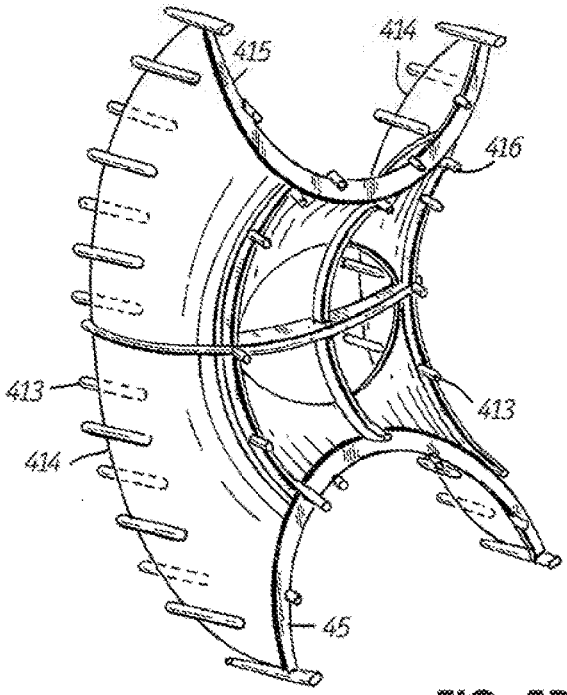

As further shown in FIGS. 1A and 1B, paramagnetic metal packings 32 are randomly distributed within the interior region 16 in between the array of holder sleeves 24. The paramagnetic metal packings 32 preferably comprise high void-volume and high-surface area porous structures. Representative examples such as carbon steel Pall rings, perforated rings, perforated saddles, and the like can be employed. FIG. 1D depicts a Pall ring 50 with its cylindrical structure with internal protrusions 52 which present a larger surface area onto which contaminates can adhere. Other examples of suitable paramagnetic metal packings are described in U.S. Pat. No. 4,041,113 to McKeown and U.S. Pat. No. 4,086,307 to Glaspie, which are incorporated herein by reference. The size of the paramagnetic metal packings 32 typically range from ⅛ to 2 inches (0.3175 to 5.08 cm). FIG. 5B shows a perforated saddle which has a plurality of drip points 413 extending from edge 414. Another set of edges 415 also have drip points 416. FIG. 5B corresponds to FIG. 2 of U.S. Pat. No. 4,086,307 to Glaspie and the edges and drips points are described in Glaspie at column 2 line 67 to column 3 line 8.

As shown in FIG. 1A, a metal screen 34 is installed at the bottom of the magnetic filter 2 below the level of the holder sleeves 24 to support the paramagnetic metal packings 32. Metal screens 54 with appropriate openings are installed at inlet pipe 4, outlet pipe 10, and flush fluid inlet pipe 36 to retain the paramagnetic metals packings 32 within the packed compartment which is the zone within the interior region 16 where the packings are distributed and confined. When the permanent magnetic bar assembles 26 are inserted into the holder sleeves 24, the magnetic fields generated by each bar assembly extend into the interior region 16 through the holder sleeves 24. As a result, the paramagnetic metal packings 32 also become magnetic so that the combined contact surface area attracting the paramagnetic contaminants is considerable.

In a preferred arrangement, the packed compartment is filled with paramagnetic metal packings of different sizes in a graded fashion, for example, with the largest ones on the top and smallest ones at the bottom. This distribution of the packings enhances the filter's ability to capture non-magnetic particles from the process fluid. The packed compartment has a void volume (volume of empty unpacked compartment minus volume of actually occupied by the solid of the packings) that is typically at least 95 percent and preferably from 96 to 99.9 percent. FIG. 5A shows a magnetic filter 2 having the same configuration as that shown in FIG. 1A except that the packing materials 32 in FIG. 1A are replaced with packing materials 32A, 32B and 32C which have different sizes.

In use, the permanent magnetic bar assembles 26 are first lowered into the holder sleeves 24. As contaminated process stream enters inlet 6 and flows into the filter interior region 16, the configurations and positions of holder sleeves 24 and baffles 70 evenly distribute the flow of contaminated fluid downward to allow the contaminated fluid to come into maximum contact with holder sleeves 24 and paramagnetic metal packings 32 in order to attract magnetic contaminants. The strong magnetic fields developed by the plurality of permanent magnetic bar assemblies 26 cause magnetic contaminants to deposit onto the outer surfaces of holder sleeves 24 and onto the surfaces of the paramagnetic metal packings 32. In addition, large particles, including both magnetic and non-magnetic contaminants, are removed from the contaminated liquid by being physically entrapped by the paramagnetic metal packings 32. Treated process fluid which is substantially free of the contaminants is channeled towards the outlet 10. The magnetic filter 2 is preferably structured as a two-stage filtration wherein the number of permanent magnetic bar assemblies 26 and the associated magnetic fields are sufficient to initially attract a desired amount of magnetic contaminants from the contaminated liquid process stream onto the outer surface of holder sleeves 24 and the paramagnetic metal packings 32 capture magnetic and non-magnetic contaminants of the desired size from the contaminated liquid process stream.

As the outer surfaces of holder sleeves 24 become evenly layered with magnetic contaminants and the packings 32 loaded with magnetic and non-magnetic contaminants, the pressure drop across magnetic filter 2 gradually increases until a programmed set point of the filter control system 72 is reached whereupon the operating cycle terminates by executing the following automatic sequence: (1) closing inlet process flow control valve 8, (2) closing outlet process flow control valve 14, and (3) removing plurality of the permanent magnetic bar assembles 26 simultaneously by raising the lifting plate 42 to releases major portions of the magnetic contaminants that have been deposited on the outer surface of holder sleeves 24 and the paramagnetic metal packings 32. The contaminants fall onto the bottom of filter housing 4. Drain valves 20 and flush fluid valve 44 are opened in sequence, allowing a flush fluid, which can be a cleaned process fluid, into the filter interior region 16. The flush fluid is introduced via inlet 36 and control valve 44 at a sufficiently high flow rate to wash off residual magnetic contaminants from the outer surface of holder sleeves 24 and to wash off both magnetic and non-magnetic contaminants from packings 32. The flush fluid, with entrained magnetic and non-magnetic contaminants, is discharged through drain pipe 18 and control valve 20.

Once the cleaning cycle is completed, automatic control systems 72 initiates the operating cycle in reverse sequence: (1) closing valve 44, (2) closing valve 20, (3) lowering lifting plate 42 to slidably reinserted the plurality of permanent magnetic bar assembles 26 into holder sleeves 24, (4) opening process fluid outlet valve 14, and (5) opening process fluid inlet valve 8.

Figure 2A:
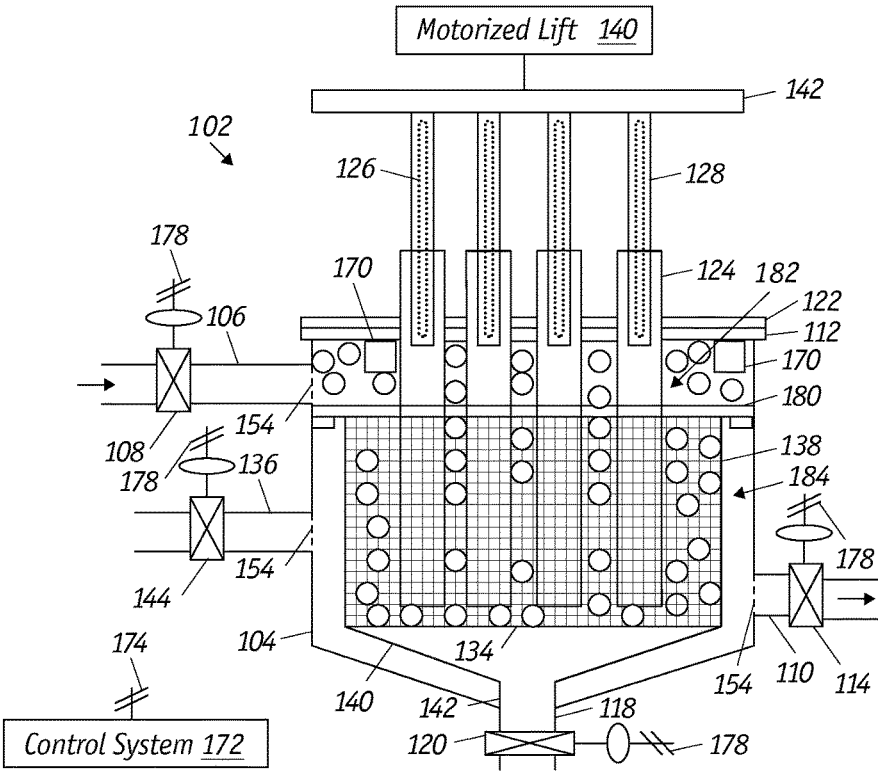
FIG. 2A and FIG. 2B are side and top views, respectively, of an embodiment of a magnetic filter with paramagnetic metal packing, removable permanent magnetic bars, and a filter screen with FIG. 2B depicting the magnetic filter with the cover plate removed and illustrating a larger number of sleeve holders.
Figure 2B:
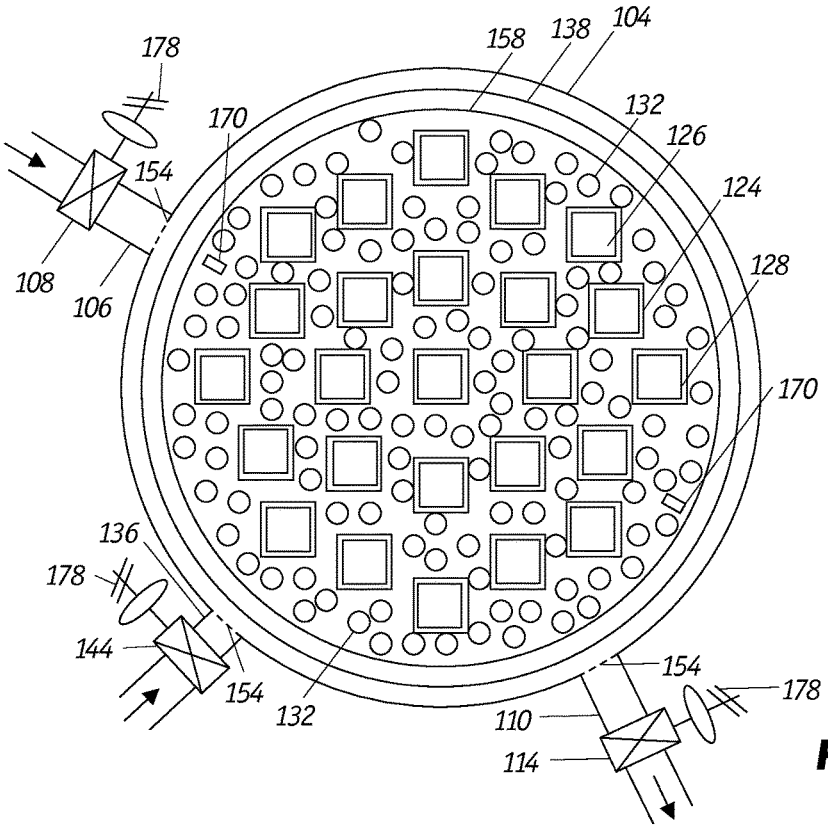

FIGS. 2A and 2B illustrate an embodiment of a magnetic filter 102 which has the same general configuration as that of magnetic filter 2 depicted in FIGS. 1A and 1B, except filter screen cylinders 138,158 are also fitted to the interior region of filter housing 104 to enclose the plurality of permanent magnetic bar assemblies 126, the holder sleeves 124, and the paramagnetic metal packings 132. Screen cylinders 138,158 have an upper rim 180, a vertical filtering section 138 and a lower cone-shaped non-filtering section 140 that has an open tube or pipe 142 and control valve 120 at the end, which is securely fitted on to drain pipe 118 that is welded to the bottom of housing 104. Metal screens 154 are installed at inlet pipe 106, outlet pipe 110, and flush fluid inlet pipe 136 to retain the randomly distributed paramagnetic metals packings 132 within a packed compartment of the filter housing 104.

Dual screen cylinders 138,158 are preferably constructed of two concentric vertically arranged layers of non-magnetic metal screens. The inner, finer screen 158 typically has a mesh size of 1 to 200 and preferably 10-100 wires per inch. The outer, coarser screen 138 typically has a mesh size of 10-100 and preferably 10-50 wires per inch. The top end of each screen is attached to rim 180 and the lower side of each screen is attached to the upper perimeter of the non-filtering section 140, which is preferably configured as a cone with tube 142 at the apex. The size of opening in tube 142 is large enough to accommodate the large particles that accumulate in the filtration process so that contaminates can be readily flushed out during cleaning cycle. The middle and lower portions of holder sleeves 124 are partially enclosed by screen cylinders 138,158 while the upper portion of holder sleeves 124 extend out from cover plate 122, which is secured to annular flange 112. A metal screen 134 at the lower end of the packed compartment supports the paramagnetic metal packings 132.

Operation of magnet filter 102 is similar to that of magnetic filter 2. With the permanent magnetic bar assembles 126 fully inserted into the holder sleeves 124, a contaminated process stream entering inlet 106 with control valve 108 initially flows into upper plenum or chamber 182. The holder sleeves 124 and baffles 170 evenly distribute the flow of contaminated fluid initially downward and outwardly into inner screen cylinder 158. The distance or gap between cover plate 122 and rim 180 should be configured to allow the contaminated fluid to come into maximum contact with the exterior surfaces of holder sleeves 124 and paramagnetic metal packings 132 to enhance collection of magnetic contaminants. The strong magnetic fields developed by the plurality of permanent magnetic bar assembles 126 within the holder sleeves 124 cause magnetic contaminants to deposit onto the outer surfaces of the holder sleeves 124 and the surfaces of the paramagnetic metal packings 132. Subsequently, as the process fluid passes through inner and outer screens 158,138 large particles, including both magnetic and non-magnetic contaminants, are removed from the liquid by the paramagnetic metal packings 132 and the dual screen cylinders. A treated process fluid which is substantially free of the contaminants is channeled towards lower plenum or chamber 184 and exits the magnetic filter through outlet 110 and control valve 114.

As the outer surfaces of holder sleeves 124 are evenly layered with magnetic contaminants, screen cylinders 138, 158 become clogged with non-magnetic contaminants, and the paramagnetic metal packings 132 are loaded with magnetic and non-magnetic contaminants, the pressure drop across the magnetic filter 104 rises eventually passing the set point of the control system 172. Upon completion of the operating cycle, the cleaning cycle begins as per the procedures described magnetic filter 2 depicted in FIG. 1A with the cleaning fluid flowing through inlet 136 and control valve 144.

Figure 3A:
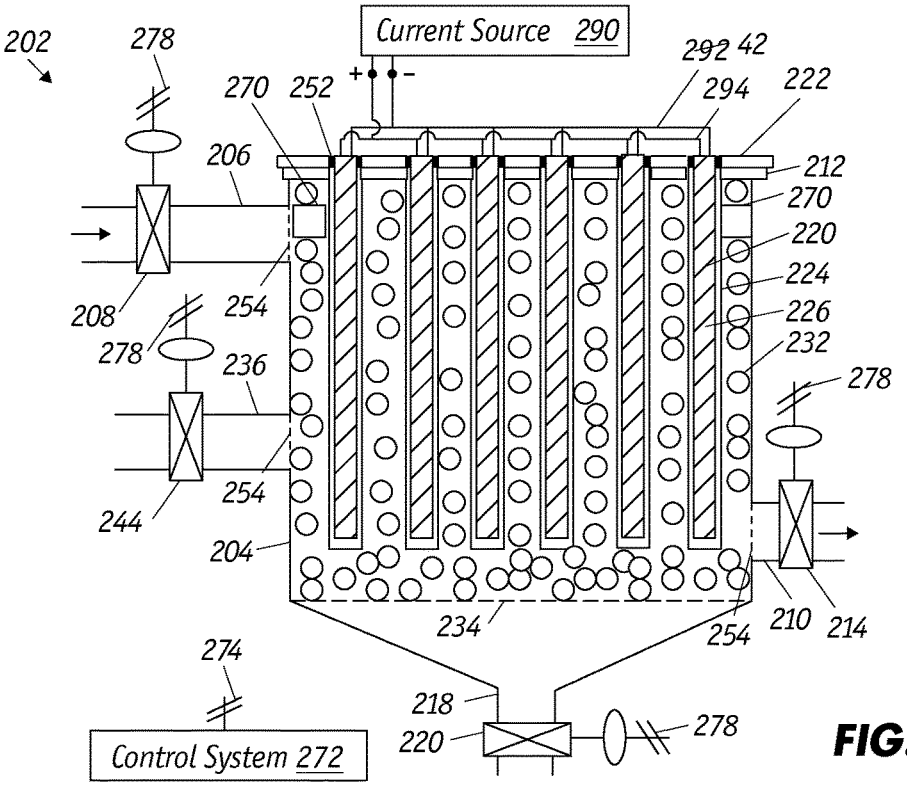
FIG. 3A and FIG. 3B are side and top views, respectively, of an embodiment of a magnetic filter with paramagnetic metal packing and fixed electromagnetic bars, with FIG. 3B depicting the magnetic filter with the cover plate removed and illustrating a larger number of sleeve holders.
Figure 3B:
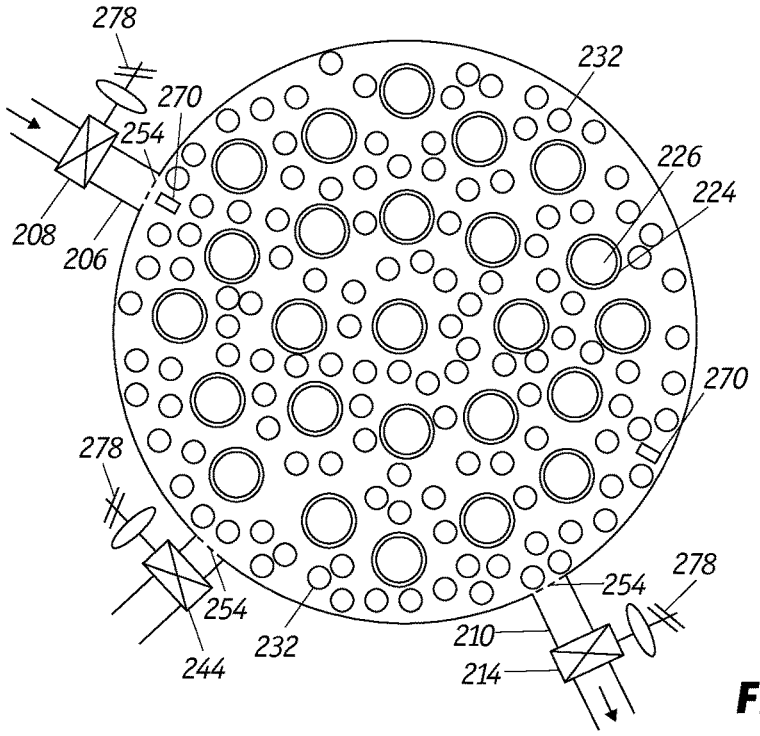

FIGS. 3A and 3B illustrate a magnetic filter 202 that is similar to the magnetic filter 2 of FIG. 1A but which features stationary, internal electromagnets. No external electric wires or coils around the housing 204 are required. The magnetic filter 202 includes a housing 204 which is equipped with a process stream inlet pipe 206 and associated control valve 208, a process stream outlet pipe 210 and associated control valve 214, cleaning fluid inlet pipe 236 and associated control valve 244, and drain pipe 218 and associated control valve 220. An array of vertically oriented elongated holder sleeves 224 is welded or securely fitted into holes on the cover plate 222 which is fastened to an annular flange 212. Paramagnetic metal cores or bars 226, which are preferably cylindrical shaped, are inserted into in the holder sleeves 224 which are constructed with non-magnetic metal such as stainless steel. Suitable paramagnetic cores are made of paramagnetic or ferromagnetic metals such as carbon steel and iron. Each paramagnetic metal bar 226 has a coil of insulated wire 220 that is closely spaced and tightly wrapped around the bar. Each wire has leads 292,294 that are connected to a direct current source 290. A magnetic field is generated by the current flowing through wire 220 and each associated paramagnetic metal bar 226 concentrates the magnetic flux. The strength of the magnetic field is proportional to the amount of current. Insulation gaskets 252 are positioned between adjacent paramagnetic metal bars 226 and holder sleeves 224 to prevent current leakage.

Paramagnetic metal packings 232 are randomly distributed within the housing 204 in between the plurality of holder sleeves 224. A metal screen 234, positioned at the bottom of the magnetic filter 202, along with metal screens 254 retain the paramagnetic metal packings 232 within the packed compartment. Baffles 270 channel the flow of contaminated process fluid through the packed compartment and into contact with the external surfaces of the holder sleeves 224 and paramagnetic metal packings 232.

Operation of magnetic filter 202 is regulated by a control system 272, which includes antenna 274 and control valve antennas 278. In particular, connection of the current source 290 to wire leads 292,294 causes paramagnetic contaminants to be attracted to and adhere to the external surfaces of a holder sleeves 224. The presence of the uniform magnetic fields also magnetizes the paramagnetic metal packings 232 so as to attract magnetic contaminants as a process stream flows through the packed compartment. The filtration and clean-up operations are essentially the same as those described for the magnetic filter 2 (FIG. 1A), except that the magnetic field disappears once the current source 290 is disconnected.

Figure 4A:
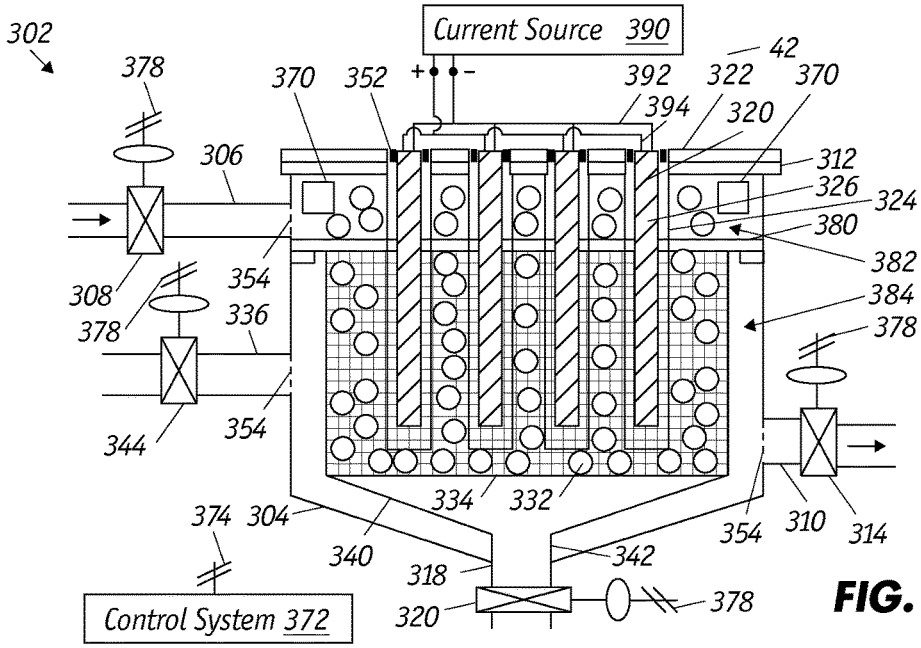
FIG. 4A and FIG. 4B are side and top views, respectively, of an embodiment of a magnetic filter with paramagnetic metal packing, fixed electromagnetic bars, and a filter screen with FIG. 4B depicting the magnetic filter with the cover plate removed and illustrating a larger number of sleeve holders.
Figure 4B:
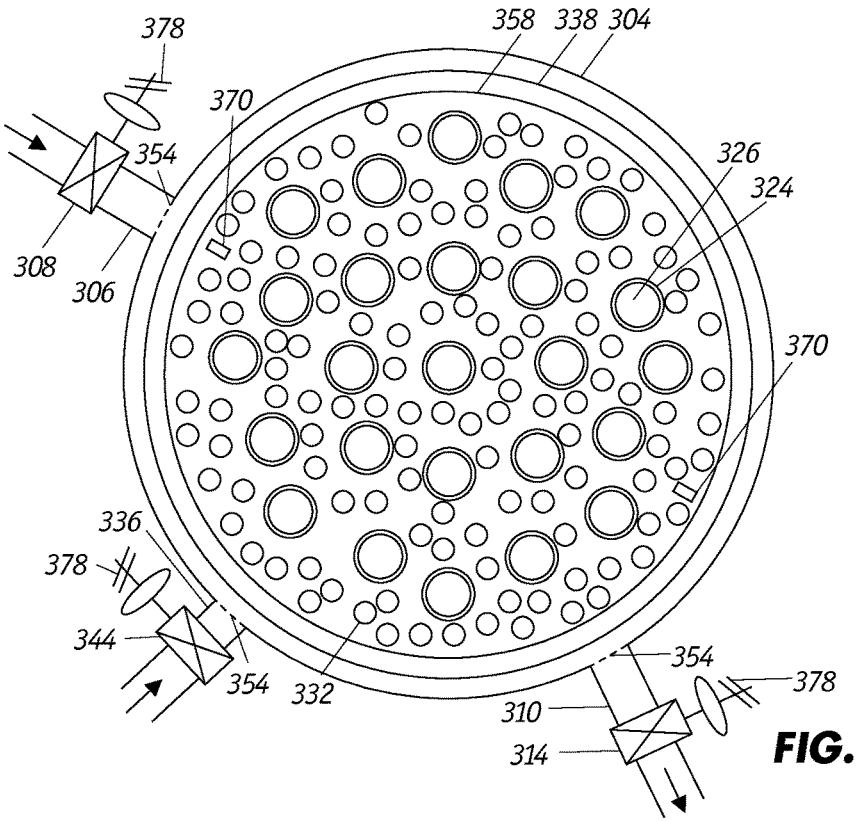

FIGS. 4A and 4B illustrate an embodiment of a magnetic filter 302 which has the same general configuration as that of magnetic 202 depicted in FIGS. 3A and 3B, except filter screen cylinders 338,358 are also fitted to the interior region within filter housing 304 to enclose a plurality of cylindrical paramagnetic metal cores or bars 326, the holder sleeves 324, and the paramagnetic metal packings 332. Screen cylinders 338,358 have an upper rim 380, a vertical filtering section 338 and a lower cone-shaped non-filtering section 340 that has an open tube or pipe 342 at the end, which is securely fitted on to drain pipe 318 with control valve 320. Dual screen cylinders 338,358 are preferably constructed of two concentric vertically arranged layers of non-magnetic metal screens 138,158 as depicted FIG. 2B. The top end of each screen is attached to rim 380 and the lower side of each screen is attached to the upper perimeter of the non-filtering section 340, which is preferably configured as a cone with tube 342 at the apex. Metal screens 354 at process stream inlet pipe 306 with control valve 308, process stream outlet pipe 310 with control valve 314, and flush fluid inlet pipe 336 with control valve 344 retain the randomly distributed paramagnetic metals packings 332 within a packed compartment of the filter housing 304.

An array of holder sleeves 324 is fitted into holes on the cover plate 322 which is fastened to an annular flange 312. Paramagnetic metal cores or bars 326 are disposed into the holder sleeves 324. Each paramagnetic metal bar 326 has a coil of insulated wire 320 that is closely spaced and tightly wrapped around the bar. Insulation gaskets 352 are positioned between adjacent paramagnetic metal bars 326 and holder sleeves 324.

Paramagnetic metal packings 332 are randomly distributed within dual screen cylinders 338,358 in between the plurality of holder sleeves 324. A metal screen 334, positioned at the bottom of the magnetic filter 302, along with metal screens 354 retain the paramagnetic metal packings 332 within the packed compartment.

Operation of magnetic filter 302 is regulated by a control system 372, which includes antenna 374 and control valve antennas 378. With leads 392,394 connected to the current source 390, a contaminated process stream flows into upper plenum or chamber 382 where baffles 370 direct the flow into contact with holder sleeves 324 and paramagnetic metal packings 332. The process stream passes through inner and outer screens 358,338 and into lower plenum or chamber 384 and exits the magnetic filter. Once the filtration process is finished upon reaching the predetermined pressure drop, the current is disconnected and the cleaning process initiated as per the procedures previously described for the operations depicted in FIG. 1A.

The robust magnetic filters can remove paramagnetic particles or sludge, and at least a portion of the non-magnetic sludge from the petroleum or chemical process streams. Carbon steel, a common material for plant construction, tends to be corroded by any acidic contaminants in a process stream of the refinery or chemical plant. As the result, ferrous ions are formed, which react with sulfur, oxygen and water to form paramagnetic FeS, FeO, $Fe(OH)_2$, $Fe(CN)_6$, etc. in the form of fine particles or visible flakes. These paramagnetic materials tend to attract other degradation sludge, making a major portion of the contaminants paramagnetic. By employing the inventive magnetic filter at appropriate streams, a substantially large portion of the contaminants can be effectively removed. It is expected that only a small percentage of the contaminants which are non-magnetic (or weak-magnetic) will not be captured. For treating contaminated streams with high non-magnetic contaminant content, the employment of the dual screens should be sufficient to remove the additional non-magnetic contaminants.

What is claimed is:

1. A magnetic filter for separating magnetic and non-magnetic contaminants from a contaminated liquid process stream that comprises:

a housing having (i) a process stream inlet (ii) a process stream outlet (iii) an interior region between the inlet and the outlet (iii) a plurality of vertically oriented, elongated non-magnetic holder sleeves positioned within the interior region;

paramagnetic metal packing material that is randomly distributed in the interior region to form a packed compartment that has a void volume which ranges from above 95 to 99.9 percent wherein the packing material comprises porous structures configured to physically entrap particle contaminants and wherein the packing material has a size that ranges from 0.3175 to 5.08 cm and wherein the packing material comprises porous structures of different sizes with smaller porous structures positioned in a lower portion of the packed compartment and larger porous structures positioned in an upper portion of the packed compartment;

one or more permanent magnets that are disposed in the holder sleeves and that generates a magnetic field within the packed compartment so that magnetic contaminants adhere to exterior surfaces of the holder sleeves and to exterior surfaces of the paramagnetic metal packing material; and means for withdrawing the one or more permanent magnets from the holder sleeves to de-activate the magnetic field within the packed compartment thereby releasing the magnetic contaminants from the exterior surfaces of the holder sleeves and from the exterior surfaces of the paramagnetic metal packing material.

2. The magnetic filter of claim 1 wherein the housing comprises an upper opening that is sealed with a cover plate and the one or more permanent magnets in each of the holder sleeves are encased in a non-magnetic tubular enclosure that is slidably received within each of the holder sleeves.

3. The claim 2 wherein the one or more permanent magnets that are disposed in each of the holder sleeves can be removed from each of the holder sleeves without having to open the cover plate and exposing the interior region to an external environment.

4. The magnetic filter of claim 1 wherein the packing material has a structure that is selected from the group consisting of Pall rings, perforated rings, perforated saddles and mixtures thereof.

5. The magnetic filter of claim 1 wherein the void volume is from 96 to 99.9 percent.

6. The magnetic filter of claim 1 comprising a screen cylinder that is positioned in the interior region wherein the screen cylinder has (i) a rim defining an opening through which the holder sleeves are disposed and (ii) a filter screen that encloses lower portions of the holder sleeves wherein the filter screen is configured to capture contaminants thereon.

7. The magnetic filter of claim 1 configured as a two-stage filtration apparatus wherein the magnetic contaminants from the contaminated liquid process stream are attached to the holder sleeves employed and the packing material and the filter screen captures magnetic and non-magnetic contaminants from the contaminated liquid process stream.

8. The magnetic filter of claim 1 wherein the holder sleeves form an array of holder sleeves that are spaced apart to form a plurality of evenly distributed channels through which the contaminated liquid process stream flows.

9. A magnetic filter for separating magnetic and non-magnetic contaminants from a contaminated liquid process stream that comprises:

a housing having (i) a process stream inlet (ii) a process stream outlet (iii) an interior region between the inlet and the outlet (iii) an array of vertically oriented, elongated non-magnetic, spaced-apart holder sleeves positioned within the interior region, wherein the array of holder sleeves form a plurality of evenly distributed channels through which the contaminated liquid process stream flows;

paramagnetic metal packing material comprising porous structures that are randomly distributed in the interior region to form a packed compartment that has a void volume which ranges from above 95 to 99.9 percent wherein the packing material comprises porous structures of different sizes with smaller porous structures positioned in a lower portion of the packed compartment and larger porous structures positioned in an upper portion of the packed compartment, wherein the packing material comprise porous structures configured to physically entrap particle contaminants and wherein the packing material has a size that ranges from 0.3175 to 5.08 cm;

one or more permanent magnets that are disposed in each of the holder sleeves and that generates a uniform magnetic field within the packed compartment so that magnetic contaminants adhere to exterior surfaces of the holder sleeves and to exterior surfaces of the porous structures; and means for withdrawing the one or more permanent magnets from the holder sleeves to de-activate the magnetic field within the packed compartment thereby releasing the magnetic contaminants from the exterior surfaces of the holder sleeves and from the exterior surfaces of the porous structures.

10. The magnetic filter of claim 9 wherein the holder sleeves have square cross sections and the one or more permanent magnets have square cross sections.

11. A magnetic filter for separating magnetic and non-magnetic contaminants from a contaminated liquid process stream that comprises:

a housing having (i) a process stream inlet (ii) a process stream outlet (iii) an interior region between the inlet and the outlet (iii) a plurality of vertically oriented, elongated non-magnetic holder sleeves positioned within the interior region;

paramagnetic metal packing material that is randomly distributed in the interior region to form a packed compartment that has a void volume which ranges from above 95 to 99.9 percent wherein the packing material comprises porous structures configured to physically entrap particle contaminants and wherein the packing material has a size that ranges from 0.3175 to 5.08 cm and wherein the packing material comprises porous structures of different sizes with smaller porous structures positioned in a lower portion of the packed compartment and larger porous structures positioned in an upper portion of the packed compartment; and electromagnets that are disposed within the plurality of holder sleeves and that generates a magnetic field within the packed compartment when the electromagnets are connected to a current source so that magnetic contaminants adhere to exterior surfaces of the holder sleeves and to exterior surfaces of the paramagnetic metal packing material and wherein the magnetic field within the packed compartment is de-activated when the electromagnetics are disconnected to the current source thereby releasing the magnetic contaminants from the exterior surfaces of the holder sleeves and from the exterior surfaces of the paramagnetic metal packing material and wherein there are no external electrical wires around the housing to produce a magnetic field within the housing.

12. A magnetic filter for separating magnetic and non-magnetic contaminants from a contaminated liquid process stream that comprises:

a housing having (i) a process stream inlet (ii) a process stream outlet (iii) an interior region between the inlet and the outlet (iii) an array of vertically oriented, elongated non-magnetic, spaced-apart holder sleeves positioned within the interior region, wherein the array of holder sleeves form a plurality of evenly distributed channels through which the contaminated liquid process stream flows;

paramagnetic metal packing material comprising porous structures that are randomly distributed in the interior region to form a packed compartment that has a void volume which ranges from above 95 to 99.9 percent wherein the packing material comprises porous structures of different sizes with smaller porous structures positioned in a lower portion of the packed compartment and larger porous structures positioned in an upper portion of the packed compartment and wherein the packing material comprise porous structures configured to physically entrap particle contaminants and wherein the packing material has a size that ranges from 0.3175 to 5.08 cm; and electromagnets that are disposed in each of the holder sleeves that generates a uniform magnetic field within the packed compartment when the electromagnetics are connected to a current source so that magnetic contaminants adhere to exterior surfaces of the holder sleeves and to exterior surfaces of the porous structures and wherein the magnetic field within the packed compartment is de-activated when the electromagnetics are disconnected to the current source thereby releasing the magnetic contaminants from the exterior surfaces of the holder sleeves and from the exterior surfaces of the porous structures.

* * * * *